United States Patent [19]

Landfors

[11] 4,251,713

[45] Feb. 17, 1981

[54] ELECTRIC HEATER ASSEMBLY FOR DIFFUSION PUMPS

[75] Inventor: Arthur A. Landfors, Newton, Mass.

[73] Assignee: Varian Associates, Inc., Palo Alto, Calif.

[21] Appl. No.: 898,567

[22] Filed: Apr. 21, 1978

[51] Int. Cl.[3] ..... F04F 9/00; H05B 3/30; H05B 3/68; F28F 1/32

[52] U.S. Cl. ..... 219/275; 165/171; 219/311; 219/436; 219/463; 219/536; 417/154

[58] Field of Search ..... 219/200, 254, 255, 258, 219/271-276, 311, 336, 406, 436, 438, 443, 463-468, 530, 534-538, 540, 542; 99/422; 38/82; 417/105, 152-154; 29/611; 165/168-171; 126/390

[56] References Cited

U.S. PATENT DOCUMENTS

| | | | |
|---|---|---|---|
| 1,573,787 | 2/1926 | Randolph | 219/542 X |
| 1,743,301 | 1/1930 | Wolcott | 219/535 X |
| 2,522,718 | 9/1950 | Huck | 219/536 X |
| 2,772,344 | 11/1956 | Bowen et al. | 219/535 X |
| 2,899,126 | 8/1959 | Sadler | 219/275 X |
| 3,227,361 | 1/1966 | Erhart et al. | 219/275 X |
| 3,258,196 | 6/1966 | Knox et al. | 219/275 X |
| 3,302,864 | 2/1967 | Nicolas | 219/275 X |
| 3,317,709 | 5/1967 | Beasley | 99/422 X |

FOREIGN PATENT DOCUMENTS

| | | | |
|---|---|---|---|
| 49807 | 1/1935 | Denmark | 219/536 |
| 611374 | 10/1948 | United Kingdom | 219/536 |

*Primary Examiner*—A. Bartis
*Attorney, Agent, or Firm*—Stanley Z. Cole; Leon F. Herbert; Allan M. Lowe

[57] ABSTRACT

A diffusion pump includes a flat metal boiler plate having an upper face defining a floor for a pool of a vaporizable diffusion pump fluid or oil and a lower face against which the metallic sheath of a tubular electric heater is pressed by a coextensive massive clamping plate. The heater has a tendency to be overheated if only air is its thermal load. To prevent overheating of the heater because of variations in the geometry of the heater sheath which tend to cause air spaces between the sheath and the face of the boiler plate, a thin flexible metal crush plate is disposed between the clamping plate and the heater. The crush plate has a plurality of spaced, raised dimples adapted to contact many portions of the heater sheath throughout the length of the sheath. As the clamping plate, the flexible plate and the heater are urged toward the boiler plate by nut and bolt assemblies securing the clamping plate to the boiler plate, the dimples are deformed whenever they are in contact with the heater sheath. The deformed dimples urge virtually the entire length of the sheath into contact with the face of the boiler plate and insure that pressure is applied to the heater sheath at the points of contact. Since there are many points of contact, the occurrence of local overheating, i.e., hot spots, is virtually eliminated.

9 Claims, 6 Drawing Figures

ELECTRIC HEATER ASSEMBLY FOR DIFFUSION PUMPS

FIELD OF THE INVENTION

The present invention relates generally to electric heaters, and more particularly, to an electric heater wherein a tubular electric heater having a tubular sheath has one side thereof in contact with raised portions of a thin, flexible metal plate.

BACKGROUND OF THE INVENTION

Diffusion pumps include a pool of oil that is vaporized in a boiler usually by a high watt density (e.g., 30 watts/in$^2$) electric heater. One prior art diffusion pump boiler includes a tubular electric heater which has been swaged into a groove in a steel platen. Heat is transferred from the tubular heater to the platen and to a flat contacting side of a metal plate which constitutes the boiler plate of the diffusion pump. Heat propagates through the platen to a flat face of a heavy metal boiler plate and then to the opposing face that forms a floor for the pool so that heat is transferred directly from the plate to the pool.

The electric heater typically comprises a metal tubular sheath, usually formed of Inconel, that surrounds a spiral filament, formed, usually of Nichrome. A space between the filament and the interior surface of the sheath is filled with a material which is both an electrical insulator and a thermal conductor, e.g., magnesium oxide. Terminals on each end of the sheath are usually threaded nickel rods welded to the ends of the filament and brought out past the ends of the sheath so that lead wires may be connected to them. These tubular heaters are easily formed into various configurations, such as circles, helices and spirals. The high watt density tubular heaters of diffusion pumps must be thermally loaded to such an extent that the heat loss from the sheath keeps all exterior sheath portions below 1500° F. Sheath temperatures in excess of 1500° F. cause rapid deterioration and, hence, short life of the heater.

In order to provide the heater with sufficient thermal loading to prevent overheating, a substantial portion of the sheath must be in contact with the boiler plate. This is not as simple as it might appear. A typical heater shape might be a 120° sector. The configuration of the tubular heating element within the boundaries of the sector is designed in such a way that it has a maximum length. In this way the watt density is kept as low as possible. It would seem that if the heater were sandwiched tightly between the boiler plate and a flat heavy clamping plate, that the side of the entire length of the heating element facing the boiler plate would be in contact with it. I have found this is not the case. The diameter of the heater sheath may have gradual variations along its length of ±0.015 inches from the mean diameter. As a result, the heater sheath makes firm contact with the boiler plate only where the diameter is at a maximum. In the absence of firm contact with the boiler plate, the transfer of heat must be accomplished by convection and radiation which is much less efficient than conduction. The temperature of the heater may become excessive at the regions where there is no contact, regions referred to as hot spots.

One structure which has been successfully employed to prevent hot spots along the length of a tubular diffusion pump electric heater is disclosed in U.S. Pat. Nos. 3,168,775 and 3,275,801. The structure of these patents includes a cast platen containing a groove into which the tubular heater is forced. The sheath of the tubular heated is then struck with a hammering tool so that the sheath abuts against the surface of the groove. The face of the platen in contact with the boiler plate is ground flat. The platen is bolted to the boiler plate. While this structure has been successful in preventing the formation of hot spots, it is relatively expensive to manufacture and the manufacturing process can result in damage to the tubular heater if the hammer blows are excessive.

It is, accordingly, an object of the present invention to provide a new and improved electric heater.

Another object of the invention is to provide a new and improved electric heater particularly adapted for diffusion pumps.

An additional object of the invention is to provide a new and improved, relatively inexpensive, electric heater having a tubular electric heater with a sheath that is loaded sufficiently so the tendency to develop hot spots is obviated, whereby the heater is susceptible to long life.

A further object of the invention is to provide a new and improved electric heater including a tubular electric heater having a sheath that is susceptible to variations in geometry but which is loaded sufficiently by an inexpensive structure to prevent hot spots from developing.

BRIEF DESCRIPTION OF THE INVENTION

In accordance with the present invention, an electric heater, particularly adapted to be utilized in a diffusion pump, comprises a tubular electric heater having a sheath. A first side of the sheath abuts against a flat face of a load to be heated by the heater; for the case of a diffusion pump, the flat face is on a boiler plate that forms a floor for a pool of vaporizable diffusion pump oil. A thin, flexible metal plate referred to as a crush plate with the same geometrical shape as the heater has elongated dimples contacting a second side of the tubular heating element. These dimples are typically spaced 2 to 3 inches apart. A relatively massive flat steel clamping plate with the same geometrical shape as the crush plate and heater is forced against the side of the crush plate opposite the dimples. The dimples are deformed whenever they are in contact with the heater sheath. The amount of deformation depends upon the sheath diameter at the point of contact. The deformed dimples urge virtually the entire length of the sheath into contact with the boiler plate. Although the amount of deformation varies at each point of contact, the deformation insures that pressure is applied to the heater shell at the point of contact. Since there are many points of contact, the occurrence of local overheating, i.e., hot spots, is virtually eliminated.

The above and still further objects, features and advantages of the present invention will become apparent upon consideration of the following detailed description of one specific embodiment thereof, especially when taken in conjunction with the accompanying drawing.

DETAILED DESCRIPTION OF THE DRAWING

Figure 1:
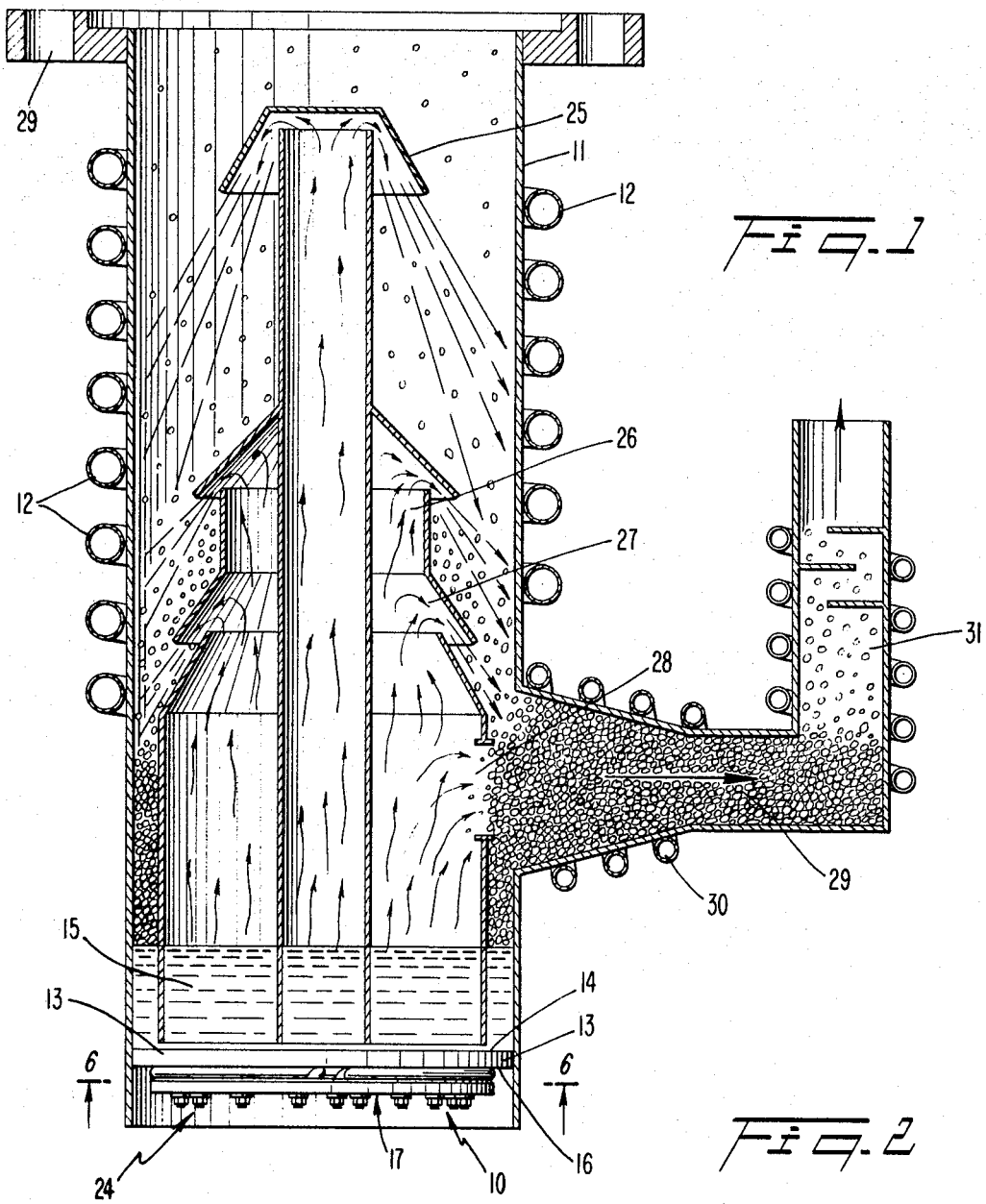
FIG. 1 is a schematic diagram of a diffusion pump with which the present invention is adapted to be particularly used.
Figure 2:
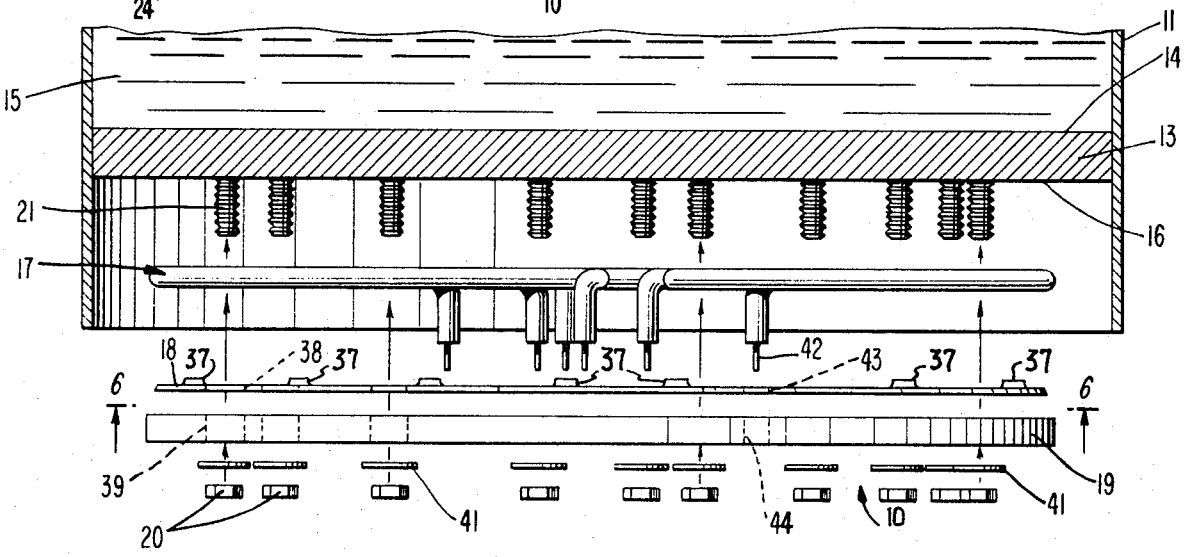
FIG. 2 is an enlarged, exploded view of the heater assembly for the diffusion pump of FIG. 1.
Figure 3:
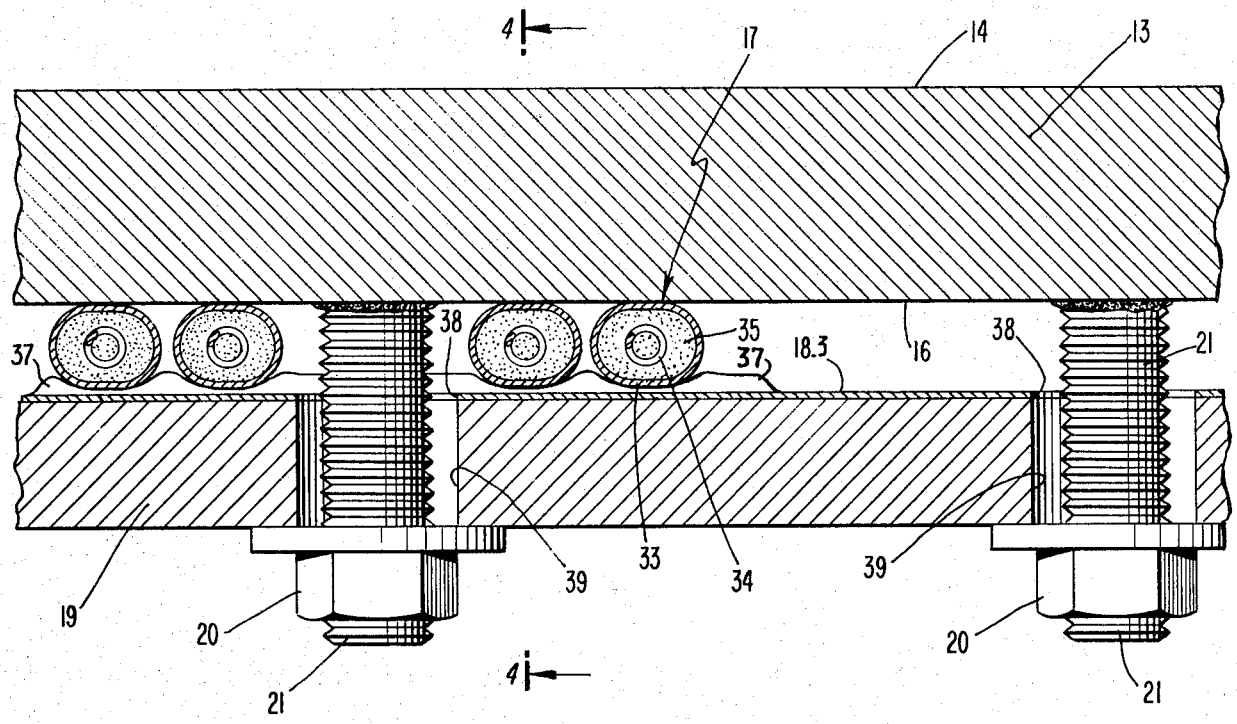
FIG. 3 is an assembled sectional view of a portion of the heater, taken along line 3—3 of FIG. 6.
Figure 4:
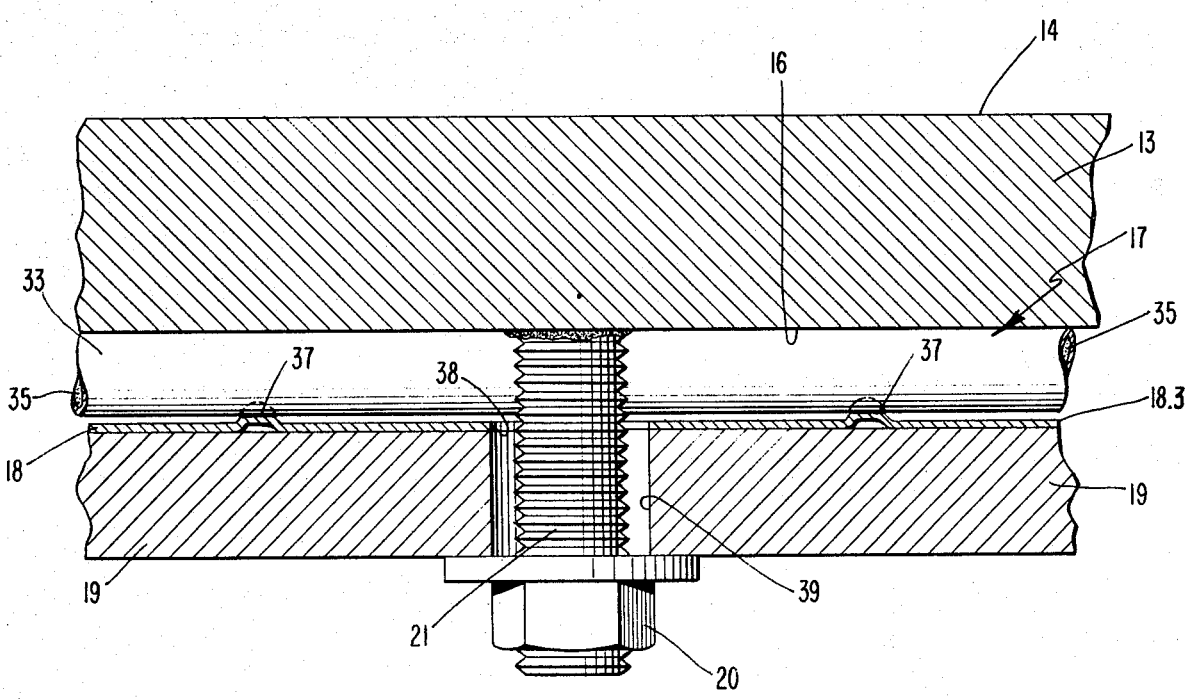
FIG. 4 is a side sectional view, taken along the line 4—4 of FIG. 3.

Reference is now made to FIG. 1 of the drawing wherein there is schematically illustrated, in cross-section, a diffusion pump including an electric heater assembly 10 in accordance with the invention. The diffusion pump includes a cylindrical exterior wall 11 that is wrapped by a spiral cooling coil 12. Secured to the bottom of cylinder 11 is a relatively massive metal, boiler plate 13, having an upper face 14 that forms a floor for pool 15 of vaporizable diffusion pump fluid or oil. Lower face 16 of plate 13 contacts a first surface of a coil-like tubular electric heater or heating element 17, having a second side that contacts thin, flexible, metal crush plate 18, which in turn abuts against a second relatively massive metal plate 19. Nuts 20, threaded onto threaded studs 21, that extend from face 16 of plate 13, and washers 41 urge plate 19 against plate 18, which in turn contacts tubular electric heater 17 to urge the heater against face 16. Thus, plates 18 and 19, in combination with tubular electric heater 17, form heater assembly 10 that heats the liquid in pool 15 to a sufficiently high temperature to cause the liquid to boil.

Vapor from pool 15 flows to a series of concentric diffusion pump nozzles 25–27 and to an ejector nozzle 28. The vapor flowing from nozzles 25–27 traps molecules from a high vacuum load connected to flange 29 and is condensed on the interior surface of cylinder 11. The condensed vapor on cylinder 11 flows, by gravity, back to pool 15 along the walls of the cylinder, in a manner well-known to those skilled in the art. In line with ejector nozzle 28 is a tapered, horizontally extending tube 29, also wrapped with a cooling coil 30. In fluid flow relationship with tube 29 is foreline 31, connected to a foreline pump in a manner well-known to those skilled in the art.

Referring to FIGS. 2–6, tubular electric heater 17 of heater assembly 10 includes a tubular, generally circular cross-section sheath 33, preferably having flat upper and lower faces. Sheath 33 is made of a suitable, relatively temperature stable metal, such as the alloy Inconel, and is formed as a flat convoluted sector having a relatively long total length. Within sheath 33 is a resistive heater coil 34, preferably fabricated of Nichrome. In the space between coil 34 and the interior surface of sheath 33 is an electrically insulating material having high thermal conductivity, such as magnesium oxide powder 35. Electric heaters having these properties are generally commercially available. However, the commercially available heaters do not have consistent geometries because the distance between opposite sides thereof is subject of ±0.015 inch variations. Hence, maintaining contact between the top side of tubular electric heater 17 and the bottom face of boiler plate 13 presents a problem, which is solved in accordance with the invention by utilizing crush plate 18 which urges the top side of sheath 33 against the bottom face of the boiler plate.

Typically, tubular electric heater 17 is energized by a three-phase, 240 volt source that supplies 8100 watts to the coil. If tubular electric heater 17 is not loaded sufficiently along its length so that substantial portions of its length are not contacted by a relatively high thermal load, the heater has a tendency to develop hot spots, i.e., the exterior surface of sheath 33 attains a temperature of 1500° F. or higher. If the exterior surface of sheath 33 attains such a high temperature, the life of coil 34 is shortened and heater assembly 10 or a significant segment thereof must be replaced.

Figure 5:
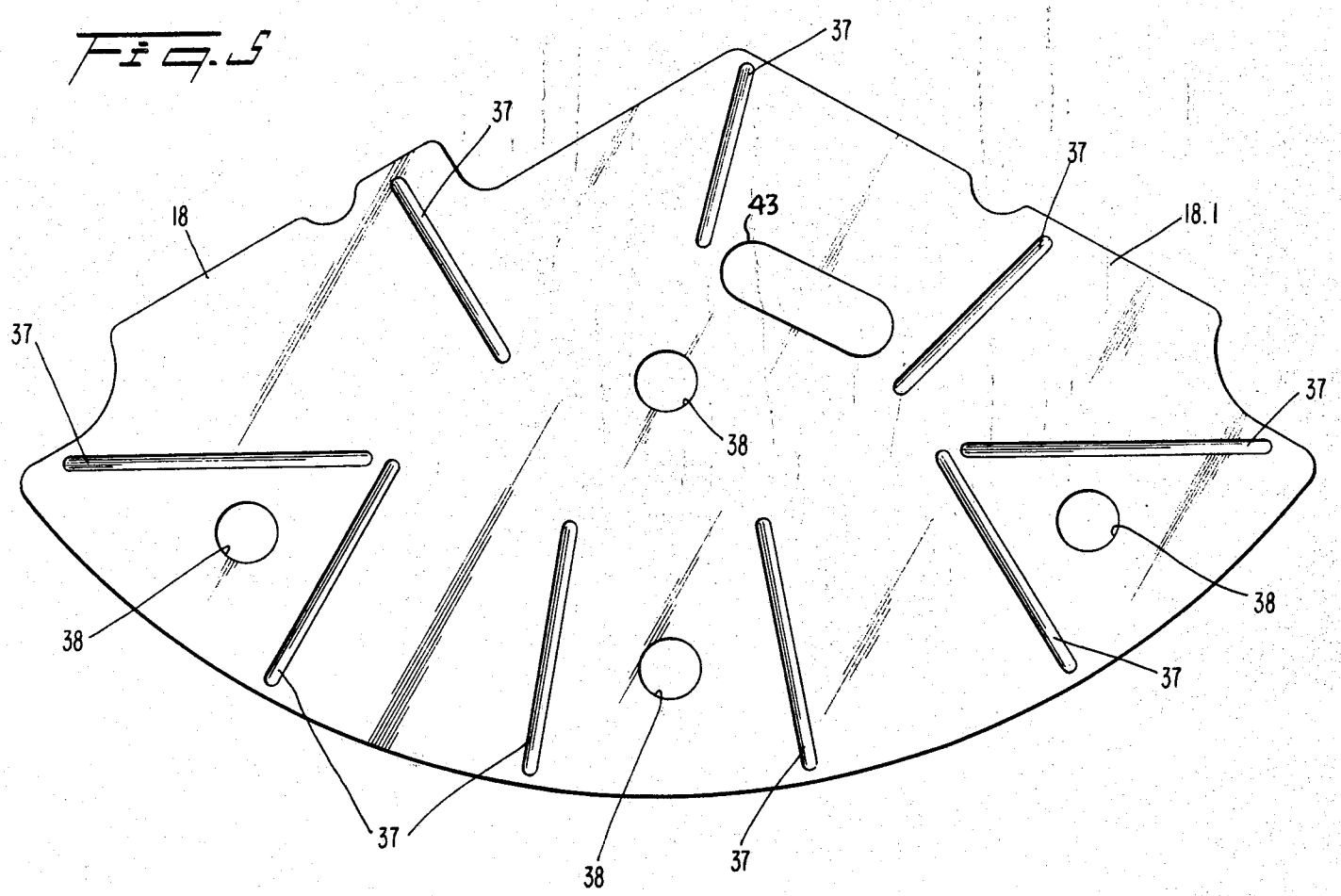
FIG. 5 is a top view of a flexible, crush plate that is employed with the heater assembly.
Figure 6:
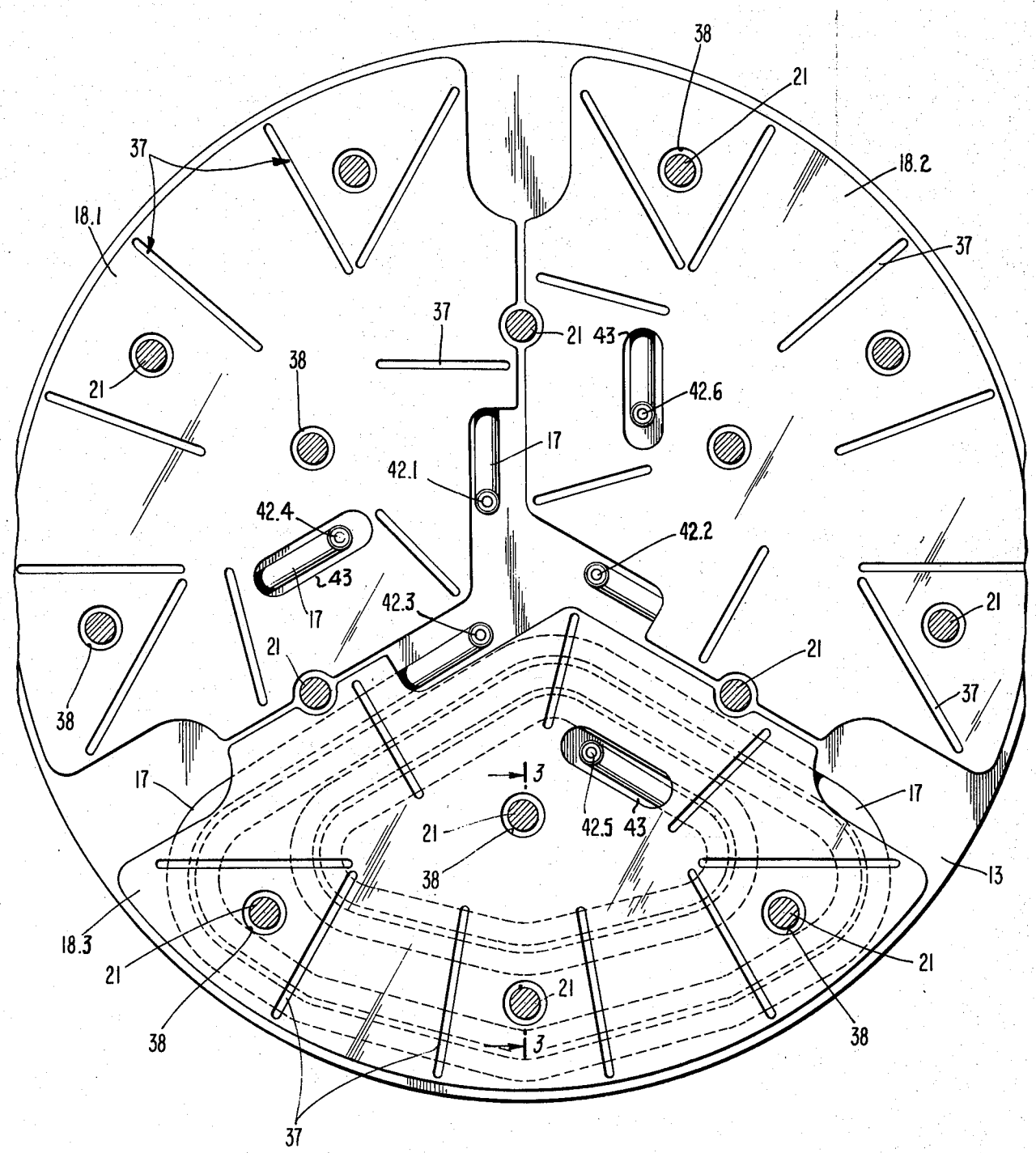
FIG. 6 is a view taken along the line 6—6 of FIG. 2.

Crush plate 18 is actually an assemblage of three plates 18.1, 18.2 and 18.3, each formed as a sector having an angular extent of 120°, as illustrated in FIGS. 5 and 6. Each of plate segments 18.1, 18.2 and 18.3 is formed of a temperature stable, flexible metal sheet of a suitable material, such as stainless steel or Inconel. In a typical embodiment, the desired flexibility is attained by forming sheet 18 with stock having a thickness of approximately 18 mils. Each plate segment includes a number of elongated segments or dimples 37, typically having a width of approximately 120 mils and a length of 3.0 inches. Dimples 37 extend approximately 90 mils from the face of plate 18 that is proximate heating element 17 and have sufficient length to engage a plurality of different segments of the heater element so that each three inch length or less of sheath 33 touches a dimple 37. The spacing of dimples 37 is sufficient to force almost the entire length of the top side of sheath 33 against the bottom face of plate 13 to prevent hot spots from developing along the surface of sheath 33. In one embodiment, dimples 37 are spaced from each other so that there is contact between adjacent dimples and the exterior of sheath 33 for at least every three inches of the length of tubular electric heater 17. In practice, this has been found to be adequate. The number of dimples could be increased if dimensional irregularities justify it.

Each of dimples 37 projects upwardly from the remainder of plate 18 to assure that there is substantial contact between the upper surface of the dimple and the lower side of sheath 33, for variations of the sheath diameter within its tolerance. Hence, for certain portions of sheath 33, as illustrated on the right side of FIGS. 3 and 4, dimple 37 is substantially depressed by the exterior of sheath 33, while other portions of sheath 33, as illustrated on the left side of FIG. 3 or 4, only slightly depress the dimple it contacts. In all instances, there is sufficient contact area between sheath 33 and the upper portion of dimples 37 to assure adequate thermal loading and heat transfer between tubular electric heater 17 and plate 13.

Plates 18 and 19 include aligned, circular apertures 38 and 39 through which studs 21 extend. Tubular electric heater 17 is similarly arranged so that studs 21 extend between spaces of adjacent turns thereof. Heater 10 is assembled by placing tubular electric heater 17 so that it abuts against lower face 16 of plate 13. Plate 18 is then placed against the side of sheath 33 that is opposite from the side of the sheath that abuts against boiler plate face 16. Plate 19 is thereafter placed against the face of plate 18 opposite from the face of that plate which abuts against one side of sheath 33. Thereafter, washers 41 are placed over studs 21 and nuts 20 are threaded onto the studs. The washers are threaded onto the studs until they urge plate 19 against plate 18, the dimples of which are crushed against one side of sheath 33, the other side of which abuts against face 16. All of dimples 37 are at least partially crushed at each contact point with sheath 33, regardless of variations in the geometry (diameter or shape) of the sheath or variations in the flatness of plate 19.

To provide three-phase electrical energization for tubular electric heater 17, the heater includes six threaded nickel rods 42.1–42.6, generally indicated by reference numeral 42, that extend from the end of sheath 33. The vertical ends of sheath 33 extend through aligned slots 43 and 44 in plates 18 and 19 respectively. A pair of centrally located rods 42.1 and 42.2 are connected to a common three-phase terminal, while the remaining centrally located rod 42.3 and one of the peripheral rods 42.4 are connected to another common three-phase terminal. The remaining exterior rods 42.5 and 42.6 are connected together and to the other three-phase terminal. The segments of tubular electric heater 17 are connected in a delta configuration, but it is to be understood that a Y connection can be employed if desired.

While there has been described and illustrated one specific embodiment of the invention, it will be clear that variations in the details of the embodiment specifically illustrated and described may be made without departing from the true spirit and scope of the invention as defined in the appended claims. For example, the elongated dimples can be replaced by numerous, judiciously placed teats to provide the desired loading.

What is claimed is:

1. An electric heater assembly particularly adapted to heat a flat bottom surface of a boiler plate for a pool of vaporizable diffusion pump fluid comprising an elongated tubular heater having a tubular sheath, said tubular heater being adapted to be energized so that it has a tendency to be overheated if only air is its thermal load, a first side of said sheath adapted to contact the flat surface of the boiler plate, a thin, metal crush plate having raised and spaced elongated segments in contact with a second side of said sheath, said segments crossing the second side of said sheath so longitudinal axes of the sheath and the segments are non-aligned at intersections between the sheath and segments, the second side being opposite from the first side of the sheath, a heavy flat plate abutting against a first face of the thin plate opposite from the face from which the segments extend, means for urging the heavy plate against the thin plate toward the tubular heater so the segments are deformed against and pressed against the second side of the sheath, said segments being urged against the tubular sheath by the heavy plate and the means for urging and having a sufficiently close spacing and adequate contact area with the sheath to urge the sheath into contact with the flat surface of the boiler plate to prevent the overheating despite geometry variations tending to cause air spaces between the sheath and the flat surface of the boiler plate.

2. The heater assembly of claim 1 wherein the tubular heater has a convoluted configuration and the raised segments are elongated dimples each adapted to extend laterally across a number of different portions of the convoluted configuration.

3. The heater assembly of claim 2 wherein the elongated dimples extend generally at right angles to the longitudinal axis of the sheath.

4. The heater assembly of claim 1 wherein each of the raised segments has a continuous, unbroken surface extending from the first face of the crush plate in a direction transverse to the longitudinal axis of the segment to provide a substantial contact between the upper surface of the raised segments and the sheath to force almost the entire length of the top side of the sheath against the flat bottom surface to prevent hot spots from developing along the surface of the sheath.

5. In combination, a diffusion pump having a pool of vaporizable fluid, a metal boiler plate having a first face defining the floor of the pool, an electric heater assembly for vaporizing the fluid, said heater assembly including: an elongated tubular electric heater having a tubular sheath, a first side of the sheath abutting against a second, substantially flat face of the boiler plate, the second face being opposite from the first face, a thin, metal crush plate having raised and spaced elongated segments in contact with a second side of said sheath, said segments crossing the second side of said sheath so longitudinal axes of the sheath and the segments are non-aligned at intersections between the sheath and segments, the second side being opposite from the first side of the sheath, a relatively massive metal clamping plate abutting against a first face of the thin plate opposite from the face from which the segments extend, means urging the heavy metal clamping plate against the first face of the thin plate and for urging the raised segments against the second side of the sheath so the segments are deformed and pressed against the second side of the sheath, said urging means urging the first side of the sheath against the second face of the boiler plate, said heater being adapted to be energized so that it has a tendency to be over-heated if only air is its thermal load, said segments being urged by the clamping plate and having a sufficiently close spacing and adequate contact with the sheath to urge the sheath into contact with the second face of the boiler plate to prevent the overheating despite variations in the geometry of the sheath.

6. The combination of claim 5 wherein the tubular electric heater has a convoluted configuration and each of the raised segments is an elongated dimple laterally extending across a number of different portions of the convoluted configuration.

7. The combination of claim 6 wherein the elongated dimples extend generally at right angles to the longitudinal axis of the sheath.

8. A diffusion pump comprising a flat metal boiler plate having an upper face defining a floor for a pool of a vaporizable diffusion pump fluid and a flat lower face, a tubular electric heater having a metallic sheath, a massive clamping plate coextensive with the heater for pressing the sheath against the lower face, the heater having a tendency to be overheated if only air is its thermal load, variations in the geometry of the heater sheath tending to cause air spaces between the sheath and the lower face of the boiler plate and thereby overheating of the heater, a thin metal crush plate having approximately the same geometric shape as the heater, said crush plate being disposed between the clamping plate and the heater, the crush plate having a plurality of spaced elongated raised dimples adapted to contact the heater sheath, nut and bolt assemblies urging the clamping plate, the crush plate and the heater toward the boiler plate to deform the dimples where they contact the heater sheath, the deformed dimples urging virtually the entire length of the sheath into contact with the lower face of the boiler plate to assure that pressure is applied to the heater sheath at the points of contact, whereby there are many points of contact to virtually eliminate the occurrence of local overheating.

9. A heater for a diffusion pump having a flat metal boiler plate having an upper face defining a floor for a pool of vaporizable diffusion pump fluid and a flat lower face, said heater comprising: a tubular electric heater having a metallic sheath, a first side of said sheath adapted to contact the flat lower face of the boiler plate, a massive clamping plate coextensive with the heater for pressing the sheath against the lower face, the heater having a tendency to be overheated if only air is its thermal load, variations in the geometry of the heater sheath tending to cause air spaces between the sheath and the lower face of the boiler plate and thereby overheating of the heater, a thin crush plate having approximately the same geometric shape as the heater, said crush plate being disposed between the clamping plate and the heater, the crush plate having a plurality of spaced elongated raised dimples adapted to contact a second side of the heater sheath, nut and bolt assemblies for urging the clamping plate, the crush plate and the heater toward the boiler plate to deform the dimples where they contact the heater sheath, the deformed dimples urging virtually the entire length of the sheath into contact with the lower face of the boiler plate to assure that pressure is applied to the heater sheath at the points of contact, whereby there are many points of contact to virtually eliminate the occurrence of local overheating.

* * * * *